US006744410B2

(12) United States Patent
Shamblin et al.

(10) Patent No.: US 6,744,410 B2
(45) Date of Patent: Jun. 1, 2004

(54) MULTI-BAND, LOW-PROFILE, CAPACITIVELY LOADED ANTENNAS WITH INTEGRATED FILTERS

(75) Inventors: Jeff Shamblin, San Marcos, CA (US); Laurent Desclos, San Diego, CA (US); Gregory Poilasne, San Diego, CA (US); Sebastian Rowson, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 101 days.

(21) Appl. No.: 10/160,811

(22) Filed: May 31, 2002

(65) Prior Publication Data

US 2003/0222826 A1 Dec. 4, 2003

(51) Int. Cl.[7] ..... H01Q 1/24; H01Q 13/10

(52) U.S. Cl. ..... 343/702; 343/767; 343/770; 343/846

(58) Field of Search ..... 343/702, 700 MS, 343/846, 767, 770, 848, 745, 746

(56) References Cited

U.S. PATENT DOCUMENTS

| | | | | | |
|---|---|---|---|---|---|
| 3,721,990 | A | | 3/1973 | Gibson et al. | 343/726 |
| 4,684,952 | A | * | 8/1987 | Munson et al. | 343/700 MS |
| 5,450,090 | A | | 9/1995 | Gels et al. | 343/700 MS |
| 5,627,550 | A | * | 5/1997 | Sanad | 343/700 MS |
| 5,781,158 | A | * | 7/1998 | Ko et al. | 343/700 MS |
| 5,943,020 | A | | 8/1999 | Liebendoerfer et al. | 343/702 |
| 6,008,762 | A | * | 12/1999 | Nghiem | 343/702 |
| 6,114,996 | A | * | 9/2000 | Nghiem | 343/702 |
| 6,133,880 | A | * | 10/2000 | Grangeat et al. | 343/700 MS |
| 6,195,051 | B1 | | 2/2001 | McCoy et al. | 343/700 MS |
| 6,304,222 | B1 | * | 10/2001 | Smith et al. | 343/702 |
| 6,323,810 | B1 | * | 11/2001 | Poilasne et al. | 343/700 MS |
| 6,348,894 | B1 | * | 2/2002 | Lahti | 343/702 |
| 2002/0126052 | A1 | * | 9/2002 | Boyle | 343/702 |

FOREIGN PATENT DOCUMENTS

| | | | |
|---|---|---|---|
| EP | 0 604 338 | A | 6/1994 |
| EP | 0 942 488 | A | 9/1999 |
| EP | 1 067 627 | A | 1/2001 |
| JP | 56 012102 | | 2/1981 |
| JP | 09 055621 | A | 2/1997 |
| JP | 2000 031735 | A | 1/2000 |
| JP | 2000 068736 | A | 3/2000 |

OTHER PUBLICATIONS

International Search Report from PCT Application No. PCT/US02/20242.

* cited by examiner

*Primary Examiner*—Hoang V. Nguyen
(74) *Attorney, Agent, or Firm*—Foley & Lardner

(57) ABSTRACT

A design and physical configuration for multi-frequency, low-profile, capacitively loaded antenna with integrated filters to be used in wireless communications. One element having one to n plates, and one antenna having one to n elements. The range of frequencies covered to be determined by the shape, size, and number of elements in the physical configuration of the antenna. Frequencies covered to be filtered by 1 to n in-line or adjunct filters.

30 Claims, 9 Drawing Sheets

Three-Dimensional View

Side-View

Top-View

MULTI-BAND, LOW-PROFILE, CAPACITIVELY LOADED ANTENNAS WITH INTEGRATED FILTERS

CROSS-REFERENCE TO RELATED APPLICATIONS

This application relates to co-pending application Ser. No. 09/892,928, filed on Jun. 26, 2001, entitled "Multi Frequency Antenna Structure and Methods Reusing the Volume of an Antenna" by L. Desclos et al., owned by the assignee of this application and incorporated herein by reference.

This application relates to co-pending application Ser. No. 10/076922, entitled "Multi Frequency Antenna Structures with a New E-Field Distribution for Very Low-Profile Antenna Applications" by G. Poilasne et al., owned by the assignee of this application and incorporated herein by reference.

This application relates to co-pending application Ser. No. 10/133,717, entitled "Low Profile, Multi-Frequency, Multi-Band, capacitively Loaded Magnetic Dipole Antenna" by G. Poilasne et al., owned by the assignee of this application and incorporated herein by reference.

BACKGROUND INFORMATION

Field of the Invention

The present invention relates generally to the field of wireless communications, and particularly to the design of multi-band antennas.

BACKGROUND

Certain applications such as the Global System for Mobile Communications (GSM) and Personal Communications Service (PCS) require that multiple bands be accessible, depending upon the local frequency coverage available from a service provider. In order to utilize a specific band for a specific application (i.e., in the context of a multi-band-capable antenna), an adjunct piece of hardware like a duplexer or filter can be used. The subject of the present invention, however, obviates the need for an adjunct duplexer or filter through an integrated filter. These filters can be either in-line or attached directly to the antenna element.

Because applications such as GSM and PCS are used in the context of wireless communication devices that have relatively small form-factors, a low profile is also a required feature of these antennas.

The present invention addresses the requirements of certain wireless communications applications by providing a configuration for multi-band, low-profile, capacitively loaded antennas with integrated filters.

SUMMARY OF THE INVENTION

This invention allows for multiple antenna elements in myriad physical configurations to cover one to n number of frequencies or bands of frequencies.

In all embodiments of the present invention there are antenna elements with both inductive and capacitive parts. Each antenna element, regardless of variations in physical design of the element, provides a single frequency or band of frequencies.

In one embodiment a single antenna element has one unshaped top plate and one bottom plate. In all embodiments, each antenna element produces a specific frequency or band of frequencies based on its relative size and shape. Different physical configurations can also be considered to adapt the antenna and its elements to the physical environment specific to a particular application.

Once the antenna elements have been cut and folded into the desired form for the purpose of matching a frequency or frequency band, they can then be arranged to target multiple bands. In one embodiment, the antenna elements can be placed one next to the other. In another embodiment, the antenna elements can be stacked, one on top of another. In yet another embodiment, the elements can be inserted one inside the other.

In all embodiments, integrated filters are used to reject unused bands. In one embodiment, the filter is a formed piece of metal that is attached to the underside of one arm of the antenna element. In another embodiment, the filter is cut out of one arm of the antenna element. Whatever the single embodiment of the filter, all of the various embodiments can be combined in a variety of physical configurations to meet the requirements of a given application. Once the multiple antenna elements have been cut, folded, and arranged to both meet the frequency and space requirements of the specific application, one has a multi-band, low-profile, capacitively loaded antenna with integrated filters.

This summary does not purport to define the invention. The invention is defined by the claims.

DETAILED DESCRIPTION OF THE INVENTION

In the following description, for purposes of explanation and not limitation, specific details are set forth in order to provide a thorough understanding of the present invention. However, it will be apparent that the present invention may be practiced in other embodiments that depart from these specific details. In other instances, detailed descriptions of well-known methods and devices are omitted so as to not obscure the description of the present invention with unnecessary detail.

In general, an antenna is developed to produce a specific frequency, band of frequencies, or combination of frequencies or bands of frequencies for a targeted application like Global System for Mobile Communications (GSM) or Personal Communications Service (PCS). The target, or resonant, frequency is a result of the inductance and capacitance of the antenna. A capacitively loaded antenna presents various advantages, chief among them excellent isolation. Different versions of capacitively loaded dipole antennas are considered herein, and each can possess different degrees of isolation as well as different bandwidths.

Figure 1A:
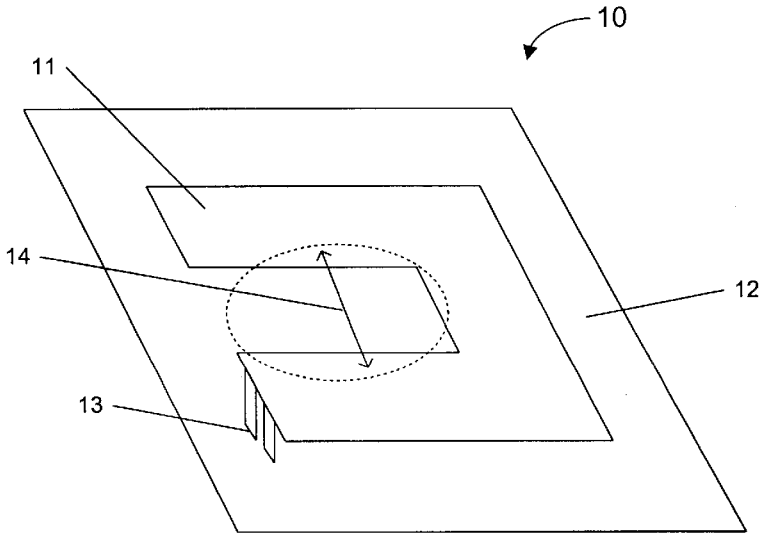
FIG. 1A is a diagram illustrating an exemplary single element, capacitively loaded antenna.

FIG. 1A illustrates a three dimensional view of one embodiment of a single-element, capacitively loaded antenna 10 in accordance with the systems and methods described herein. In this configuration there is a top plate 11, a grounding plate 12, and a grounding point 13 electrically connecting top plate 11 with ground plate 12. Top plate 11 also comprises a cutout "u" shape between the two arms of the top plate. This cutout comprises part of the capacitive part 14 of antenna 10.

Figure 1B:
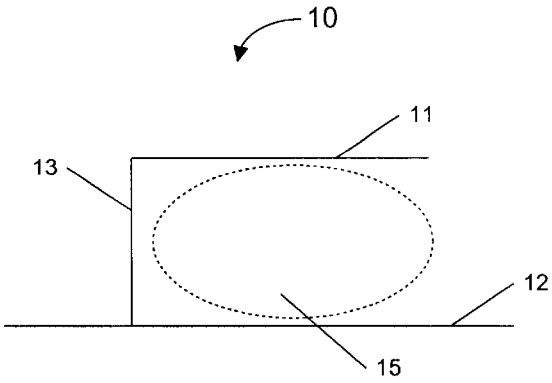
FIG. 1B is a diagram illustrating a side view of the antenna of FIG. 1A.

FIG. 1B illustrates a side-view of one embodiment of single-element, capacitively loaded antenna 10, in accordance with the systems and methods described herein. Again, top plate 11, grounding point 13, and ground plane 12 are illustrated, but this time from the side. The space between the top plate and grounding plane comprise an inductive part 15 of antenna 10.

Figure 1C:
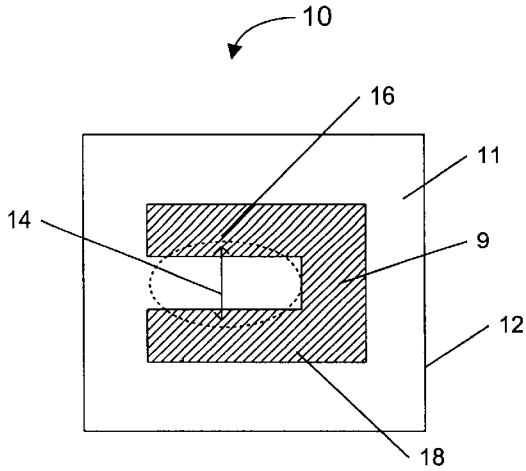
FIG. 1C is a diagram illustrating a top view of the antenna of FIG. 1A.

FIG. 1C illustrates a top-view of one embodiment of single-element, capacitively loaded antenna 10, in accordance with the systems and methods described herein. As can be seen, top plate 11 comprises two arms, or plates 16 and 18, respectively. Top plate 11 also comprises a connecting section 9 that connects plates 16 and 18.

The characteristics and operation of antenna 10 are fully disclosed in Co-pending U.S. patent application Ser. No. 10/133,717, which as mentioned above is fully incorporated herein by reference in its entirety. Specifically, FIGS. 6A–6C and the accompanying description detail the various characteristics and operation of a single element, capacitively loaded antenna, such as antenna 10. These figures and the accompanying description are specifically incorporated herein by reference as though set forth in full.

Antenna 10 can be used as one element of a multi-element antenna configured to operate in a plurality of frequency bands. Essentially, Once the elements comprising antenna 10 have been cut and folded into the desired form for the purpose of matching a frequency or frequency band, it can be combined with other single element antennas and arranged to target multiple bands. For example, a plurality of single element antennas, such as antenna 10, can be placed one next to the other, stacked one on top of another, and/or inserted one inside the other. FIGS. 7A–7B, 8A–8D, and 9A–9C of Co-pending U.S. patent application Ser. No. 10/133,717 and the accompanying descriptions detail various configurations and arrangements for constructing a multi-band antenna comprising a plurality of single element antennas, such as antenna 10. These figures and the accompanying descriptions are specifically incorporated herein by reference as though set forth in full. As illustrated in FIG. 3B of Co-pending U.S. patent application Ser. No. 10/133,717, the frequency coverage for the resulting multi-band antenna is then the combined frequency coverage for each of the single element antennas 10 combined to form the multi-band antenna. Thus, for example, a dual-band antenna configured to cover the 800 MHz band and the 1900 MHz band can be formed by combining a single element antenna 10 with coverage in the 800 MHz range with a single element antenna 10 with coverage in the 1900 MHz range.

Figure 3:
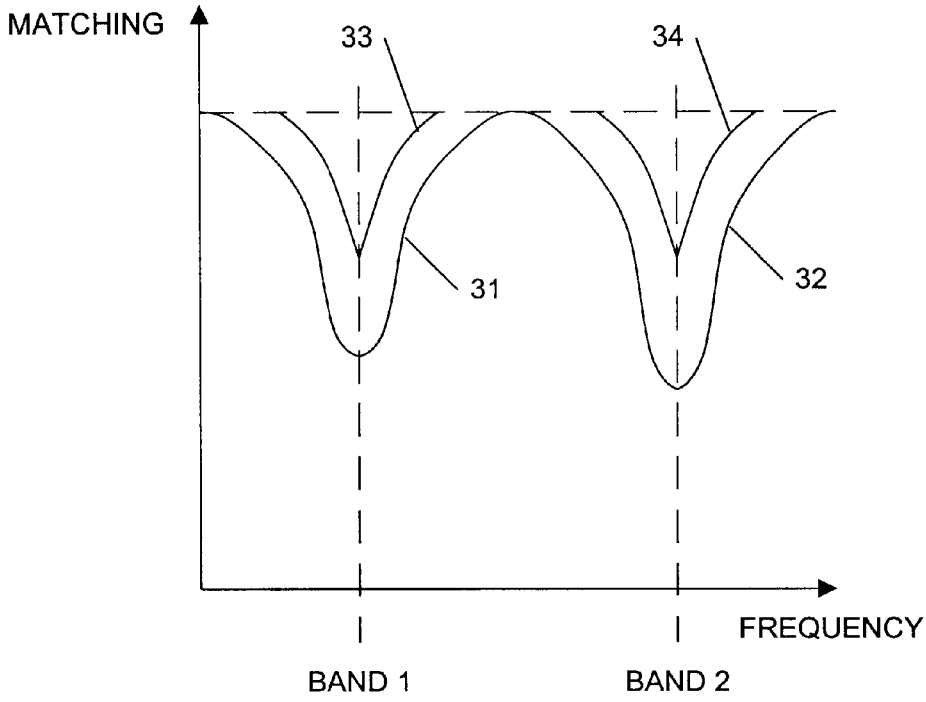
FIG. 3 is a plot of the return loss of an exemplary dual-band antenna.

In FIG. 3 of the present application, however, we see that simply combining single element antennas can result in unsatisfactory performance if some type of filtering is not also included. FIG. 3 illustrates a return loss plot of a dual band antenna prior to incorporating filtering. As can be seen, one antenna element 10 comprising the dual-band antenna has a response at frequency band 1 (band 1) as illustrated by return loss trace 31. The other antenna element 10 has a response at frequency band 2 (band 2) as illustrated by return loss trace 32. But there are also smaller responses 33 and 34 on the return loss trace due to energy in one band being coupled to the other band. This unwanted coupled energy is due to poor isolation between the two antenna elements 10 that comprise the dual-band antenna. In other words, when one of the elements is excited and therefore begins to resonate at its operating frequency, energy from the excited element is coupled to the other antenna element. This coupling from one element to the other results in the smaller responses 33 and 34, which degrade the performance of the dual-band antenna. With proper isolation, the responses 33 and 34 are suppressed, because little or no energy is coupled from one antenna element to the other.

Figure 4:
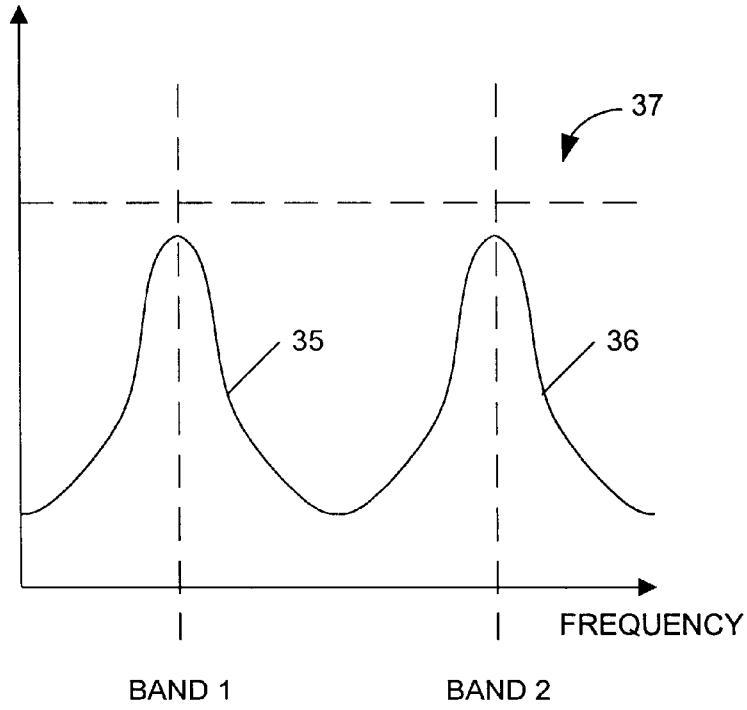
FIG. 4 is a plot of the frequency response of the dual-band antenna of FIG. 3.

FIG. 4 illustrates a plot 37 of the frequency response of a dual-band antenna that results when one of the antenna elements that comprise the dual-band antenna is excited with a signal. As can be seen, the response actually comprises two responses 35 and 36, one for each band of coverage. Plot 37 illustrates that the rejection between the two frequency bands is poor. The rejection is dependent upon many factors, including: the specific geometry of the antenna; the separation in frequency between the two excited bands, e.g., band 1 and band 2; and the frequency characteristics of the feed lines feeding the respective antenna elements in terms of their inherent filtering characteristics. The isolation and rejection of the dual-band antenna can, however, be improved with the use of filtering as described herein.

Figure 2A:
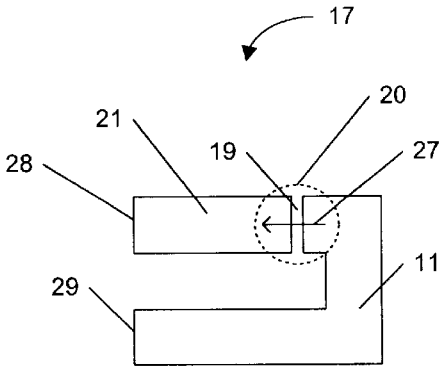
FIG. 2A is a diagram illustrating the top view of an antenna element that includes a filter element in accordance with the invention.

To improve the isolation and filtering of a multi-band antenna, a high or low pass filter can, for example be included in one or more feed lines powering the various elements comprising the multi-band antenna. Alternatively, the filters can be integrated with the antenna elements. FIG. 2A illustrates a top-view of one embodiment of a single antenna element 17 that comprises one element of a multi-element, multi-frequency, capacitively loaded antenna, in accordance with the systems and methods described herein. As with antenna 10 in FIG. 1, antenna element 17 also comprises a top plate 11, a ground plate, and a grounding contact; however, for ease of illustration, the ground plate and grounding contact are omitted from FIGS. 2A–2C Top plate 11 of antenna element 17 is configured in a "U" shape, as with antenna 10, comprising two plates 28 and 29 formed such that they are adjacent to and substantially parallel to each other, although it is possible for the two plates 28 and 29 to be oriented in some other manner. A filter element 20 has been added to plate 28 in order to improve the isolation of antenna element 17 relative to at least one other element comprising the multi-element, multi-frequency, capacitively loaded antenna. In this particular embodiment, filter element 20 comprises a cutout 19 that runs the width of plate 28 and that divides plate 28 into two parts. The first part is a cutout plate 21, and the second part is the part formed form the rest of top plate 11, which can be termed the base plate. It will be understood that so configured, cutout plate 21 becomes a parasitic element of antenna element 17. Cutout plate 21 is powered through electromagnetic coupling, indicated by line 27, with the base plate.

The position and width of cutout 19 can then be tailored to provide the desired filtering characteristics to filter element 20. Essentially, the desired filtering characteristics are those that will allow proper performance of antenna element 17, while improving the isolation and/or rejection, for example, with respect to other antenna elements. Once the geometry of a filter element 20 is defined, the filter element can be replicated in order to add a plurality of filter elements 20 to antenna element 17. Additional filter elements 20 may be added, for example, to further improve the isolation and/or rejection of antenna element 17.

Figure 2B:
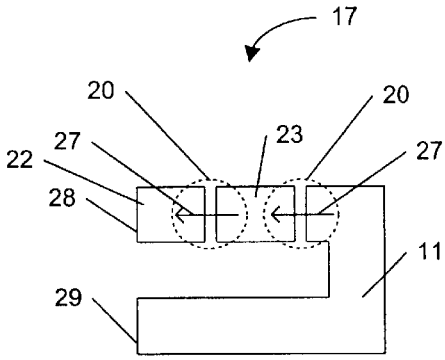
FIG. 2B is a diagram illustrating the antenna element of FIG. 2A with two filter elements in accordance with the invention.
Figure 2C:
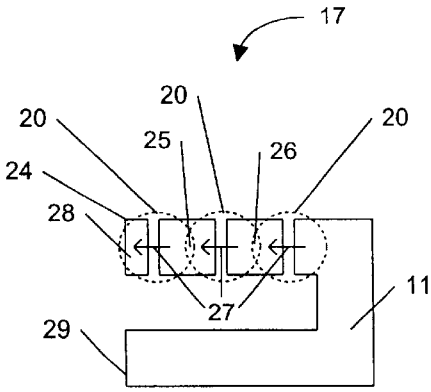
FIG. 2C is a diagram illustrating the antenna element of FIG. 2A with three filter elements in accordance with the invention.

Accordingly, FIG. 2B illustrates a top-view of antenna element 17 that comprises two filter elements 20 that divide plate 28 into two cutout plates 22 and 23, each driven by electromagnetic coupling 27. FIG. 2C illustrates a top-view of antenna element 17 that comprises three filter elements 20 that divide plate 28 into three cutout plates 24, 25, and 26, each driven by electro-magnetic coupling 27. More filter elements 20 can be added as required, and each can be driven by electro magnetic coupling 27. Thus, the electro-magnetic coupling can actually be configured to drive form 1 to n cutout plates as required by a particular invention.

Figure 2D:
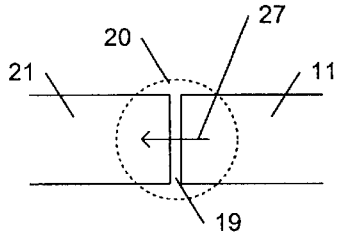
FIG. 2D is a diagram illustrating a close up view of the filter element of FIG. 2A.
Figure 2E:
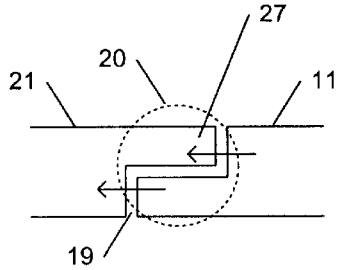
FIG. 2E is a diagram illustrating an alternative embodiment of the filter element of FIG. 2D.

Again, once the geometry for a particular filter element 20 is defined, it can be replicated as required to add a plurality of such elements to an antenna element 17. Further, different geometries can be defined to provide different filtering characteristics. For example, FIG. 2D illustrates a close up view of the embodiment of a filter element 20 illustrated in FIG. 2A. FIG. 2E, on the other hand, illustrates an alternative embodiment of filter element 20 comprising a different geometry. As with the embodiment of FIG. 2D, the filter element 20 illustrated in FIG. 2E also comprise a cutout 19 that forms a cutout plate 21 and a base plate 11. Again, electromagnetic coupling 27 powers cutout plate 21. This creates an example of more complex filter including an inductance and capacitance.

Figure 2F:
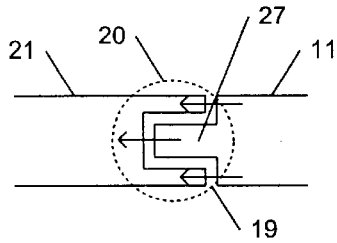
FIG. 2F is a diagram illustrating another alternative embodiment of the filter element of FIG. 2D.

FIG. 2F illustrates another alternative embodiment of a filter element 20. Again, the filter element 20 of FIG. 2F comprises a cutout 19 that divides plate 28 into a cutout plate 21 and a base plate 11, with cutout plate 21 being powered by electromagnetic coupling 27. This creates an example of more complex filter including an inductance and capacitance.

Figure 2G:
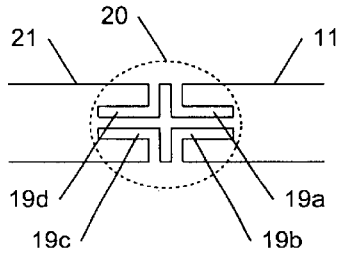
FIG. 2G is a diagram illustrating still another alternative embodiment of the filter element of FIG. 2D.

FIG. 2G illustrates still another embodiment of filter element 20. In this embodiment, filter element 20 comprises a plurality of cutouts 19*a*–19*d*. But cutouts 19*a*–19*d* do not separate plate 28 into two different plates as with previous embodiments. The filter that results from filter element 20 in FIG. 2G is a second order filter. Thus, the geometries of cutouts 19*a*–19*d* can be configured to result in poles in the filter's transfer function at the desired frequencies.

Figure 5:
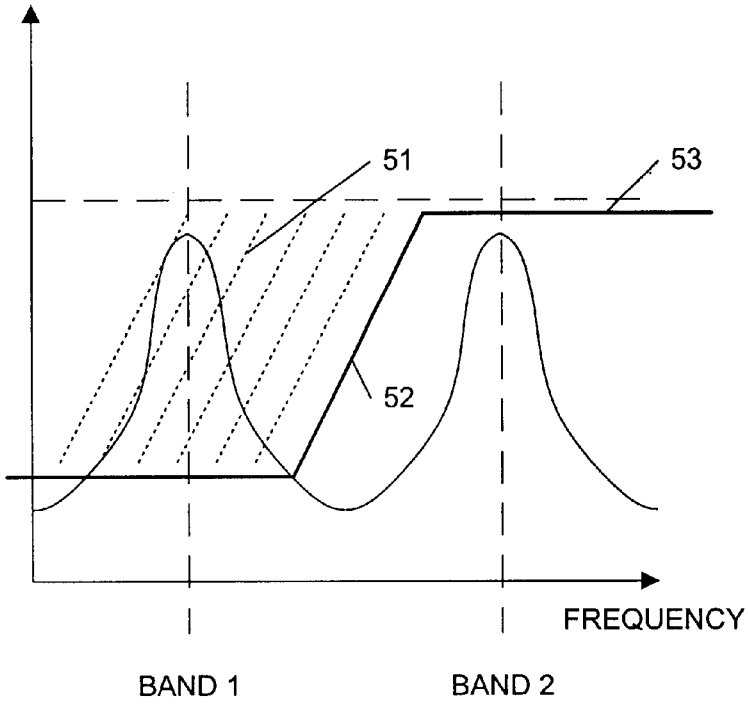
FIG. 5 is a diagram illustrating the effect of a high pass filter on the frequency response of the dual-band antenna of FIG. 3.

As mentioned, the filters can be high or low pass filters depending on the embodiments and what frequencies need to be rejected. Thus, for example, returning to the frequency response of 37 of a dual-band filter designed in accordance with the systems and methods described herein, one antenna element can include a high pass filter to filter out the lower frequency band (band 1), while the other antenna element includes a low pass filter to filter out the higher frequency band (band 2). FIG. 5 illustrates the pass and reject bands of a high-pass filter and the effect the filter has on the two frequency responses of a dual-band antenna. The shaded region 51 indicates the portion of the response that is suppressed by the filtering. Accordingly, a filter element 20 can be configured such that it provides the transfer function 53 illustrated in FIG. 5.

As mentioned, the filtering can be in the feed line or included in antenna element 17 as described in FIGS. 2A–2G. In either event, however, filter elements 20 can be added to the antenna element to increase the rejection of the filter. Adding filter elements 20 increases the slope 52 of the transfer function 53, which allows greater rejection of band 1 signals.

Figure 6:
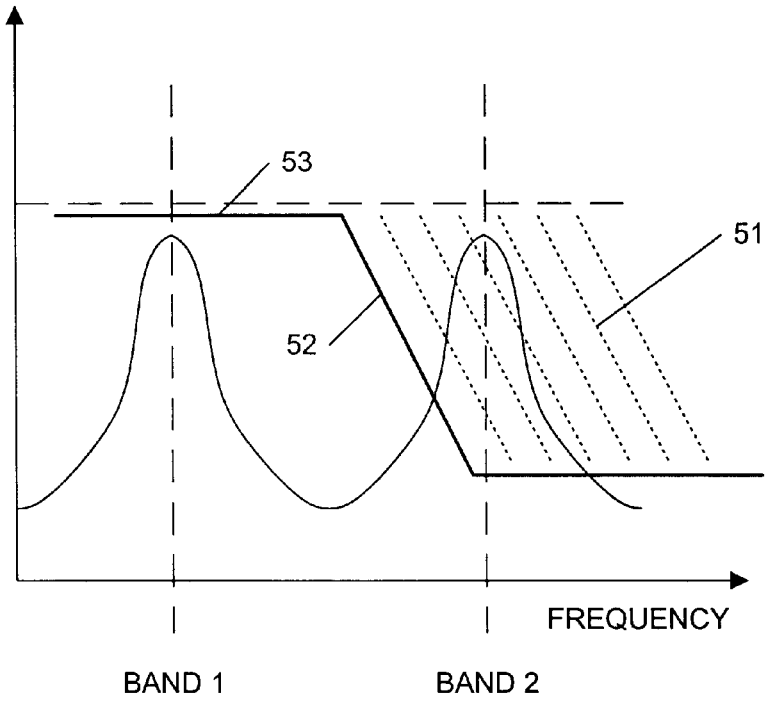
FIG. 6 is a diagram illustrating the effect of a low pass filter on the frequency response of the dual-band antenna of FIG. 3.

FIG. 6, on the other hand, illustrates the pass and reject band of a low pass filter, which can be incorporated into the feed line or in the antenna element 17. Like the high-pass filter, additional filtering sections 20 can be added to increase the isolation between the two frequency responses, by increasing the slope 52 of transfer function 53. The shaded region 51 indicates the part of the frequency response that is suppressed by the filtering.

Figure 7:
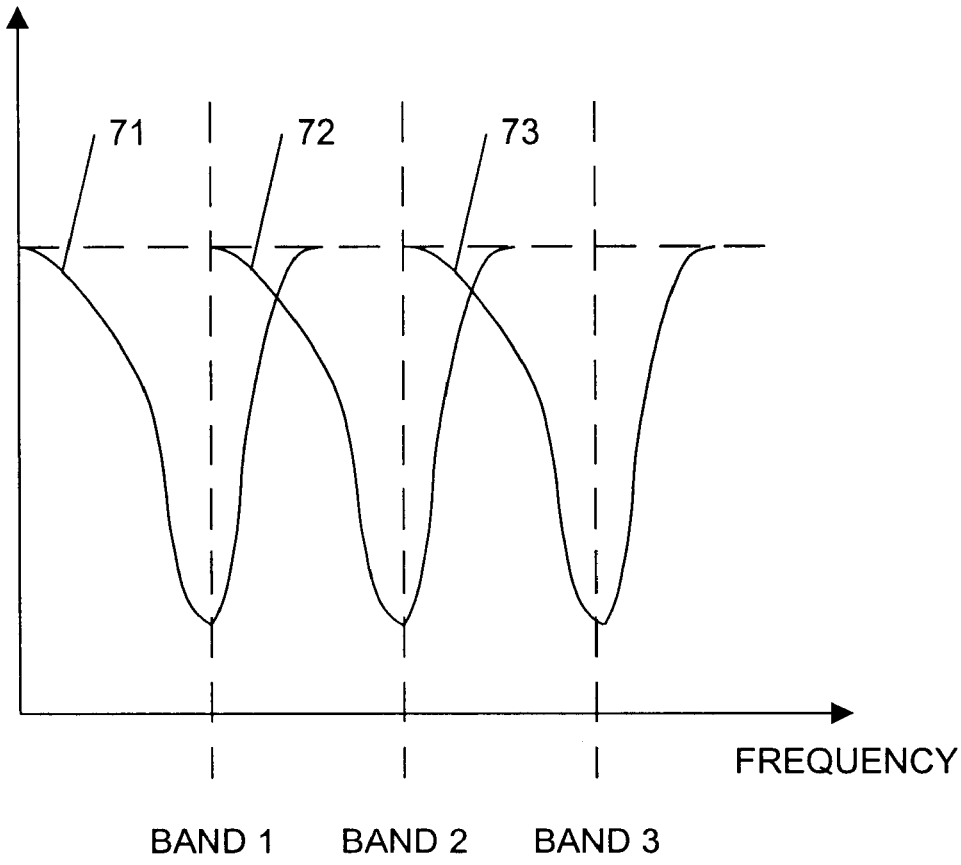
FIG. 7 is a plot of the return loss for a tri-band antenna that incorporates filtering in accordance with the invention.

FIG. 7 illustrates the return loss plot of a tri-band antenna comprising three antenna elements 17 and filtering in accordance with the present invention. The filtering can be included in one or more feed lines and/or in the three antenna elements 17 as described above. The three separate return loss plots 71, 72, and 73 show no additional responses, which is an indication of adequate filtering.

Figure 8A:
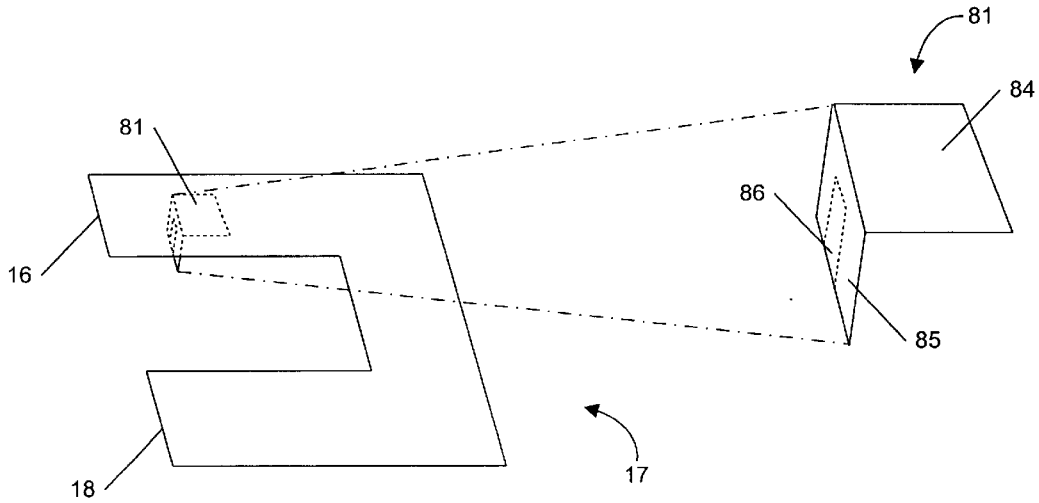
FIG. 8A is a diagram illustrating an antenna element comprising an alternative embodiment of a filter element coupled with the antenna element in accordance with the invention.

Other types of filtering elements can be used in accordance with the systems and methods described herein, besides those illustrated, for example, in FIGS. 2A–2G. FIG. 8A illustrates one embodiment of an antenna element 17 that forms a part of a multi-element, multi-frequency, capacitively loaded antenna, in accordance with the present invention. Again, only top plate 11 of antenna element 17 is shown for simplicity. Antenna element 17 also includes a filter element 81 that serves to reject unsupported frequencies. As shown in the blown up view of FIG. 8A, filter element 81 comprises a bottom plate 84 that is electro-magnetically connected with plate 16 of top plate 11. Filter element 81 also comprises a plate 85 that extends down from plate 16 in a substantially perpendicular orientation to plate 16. Other orientations for plate 85 relative to plate 16 are of course possible.

Preferably, plate 85 is a capacitive plate, i.e., plate 85 preferably forms a capacitance such that filter element 81 is a capacitive filter element with the desired filtering characteristics. In one embodiment, therefore, plate 85 can, like top plate 11, comprise a cutout section 86 so that plate 85 comprises a "u" shape. So formed, plate 85 can generate a capacitive part of filter element 81 in the same manner that top plate 11 forms a capacitive part 14 of antenna 10 as illustrated in FIG. 1C.

Figure 8B:
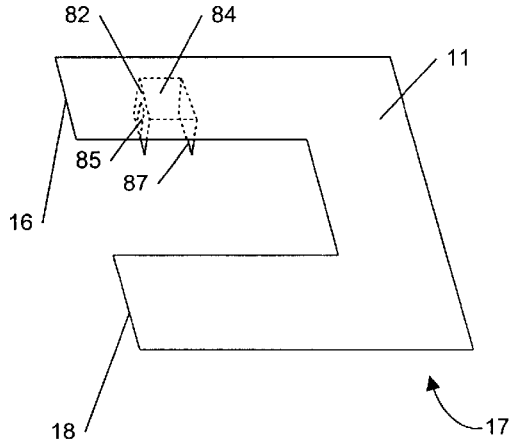
FIG. 8B is a diagram illustrating the antenna element of FIG. 8A coupled with another alternative embodiment of a filter element in accordance with the invention.

Other, more complex, filter elements can be generated from the relatively simple capacitive filter element 81. For example, an Inductive-Capacitive (LC)-filter 82 is illustrated in FIG. 8B. Like filter element 81, filter element 82 can comprise a bottom plate 84 and a capacitive plate 85. In addition, filter element 82 can also include a second plate 87. This second plate 87 can be configured to form an inductive part of filter element 82 in much the same way that ground plate 12 can be configured to form an inductive part 15 of antenna 10 in FIG. 1B.

Figure 8C:
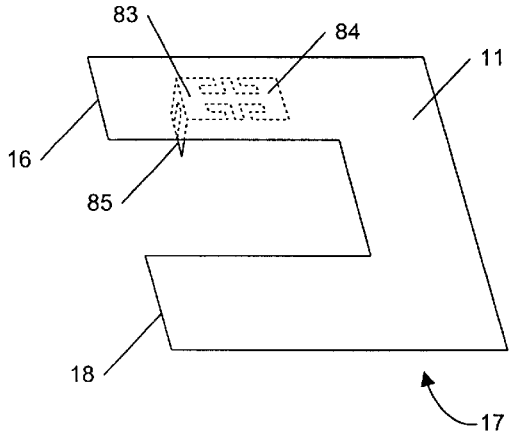
FIG. 8C is a diagram illustrating the antenna element of FIG. 8A coupled with still another alternative embodiment of a filter element in accordance with the invention.

FIG. 8C illustrates another possible filter element 83 configured, as with filter elements 81 and 82 to reject unsupported frequencies. In filter element 83, bottom plate 84 has been cut so as to form a second order filter with capacitive plate 85.

Figure 9A:
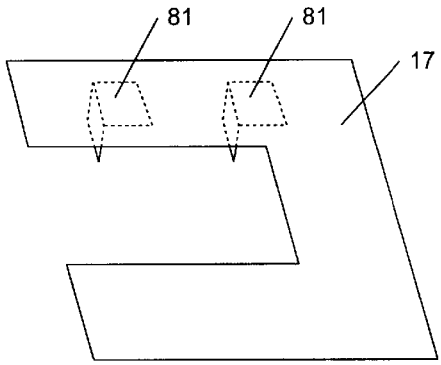
FIG. 9A is a diagram illustrating the filter element of FIG. 8A coupled with two of the filter elements illustrated in FIG. 8A.
Figure 9B:
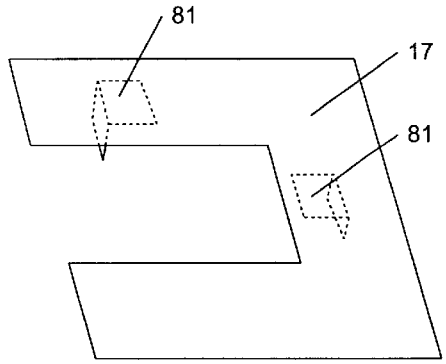
FIG. 9B is a diagram also illustrating the filter element of FIG. 8A coupled with two of the filter elements illustrated in FIG. 8A arranged in a different location relative to the filter elements of figure 9A.
Figure 9C:
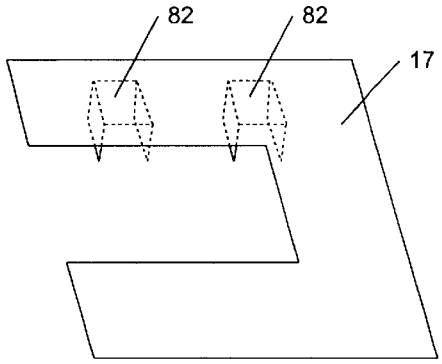
FIG. 9C is a diagram illustrating the filter element of FIG. 8A coupled with two of the filter elements illustrated in FIG. 8B.
Figure 9D:
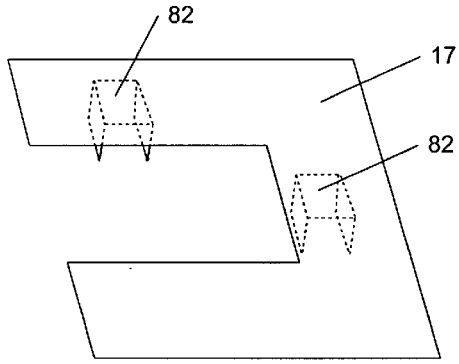
FIG. 9D is a diagram also illustrating the filter element of FIG. 8A coupled with two of the filter elements illustrated in FIG. 8B arranged in a different location relative to the filter elements of FIG. 9C.

Once the basic filter elements are designed, they can be added as needed to antenna element 17. For example, two filter elements 81 can be used if required by a particular implementation as indicated in FIG. 9A. As indicated in FIG. 9B, the location of the various filter elements can also be selected based on a particular application's requirements. Thus, one filter element 81 can be added to one arm of filter element 17, while another is added to the connecting section between the two arms. Similar configurations can be implemented using filter elements 82 as indicated in figured 9C and 9D.

Figure 10A:
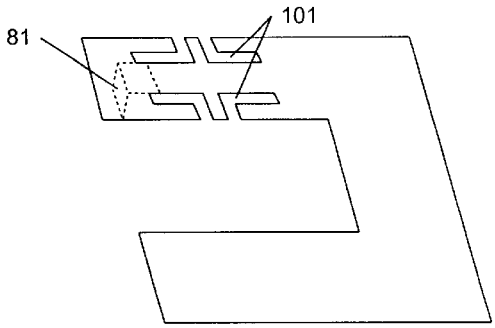
FIG. 10A is a diagram illustrating an antenna element comprising the filter element of FIG. 2G and coupled with the filter element of FIG. 8A.
Figure 10B:
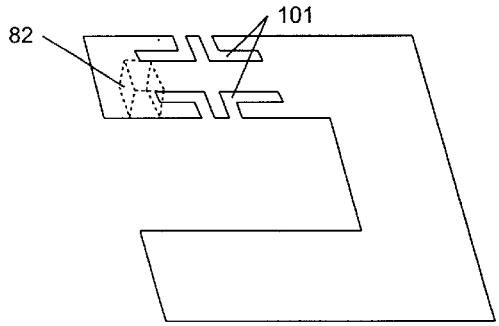
FIG. 10B is a diagram illustrating an antenna element comprising the filter element of FIG. 2G and coupled with the filter element of FIG. 8B.
Figure 10C:
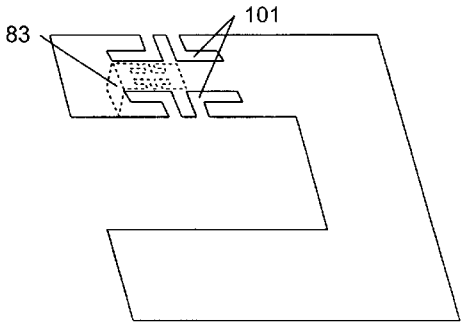
FIG. 10C is a diagram illustrating an antenna element comprising the filter element of FIG. 2G and coupled with the filter element of FIG. 8C.
Figure 10D:
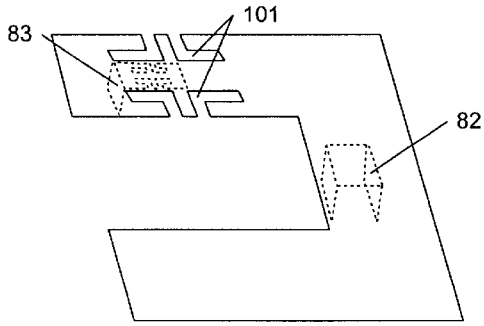
FIG. 10D is a diagram illustrating an antenna element comprising the filter element of FIG. 2G and coupled with the filter elements of FIGS. 8B and 8C.

In general, it should be remembered that once a filter element is defined, whether it is a cutout filter element 20 or one that is coupled with antenna element 17, such as filter elements 81–83, the filter element can be combined with other similar filter elements or with other types of filter elements to provide the required filtering. Thus, in FIG. 10A for example, a cutout filter element 101 is combined with a filter element 81. In FIG. 10B cutout filter 101 is combined with a filter element 82. In FIG. 10C filter element 101 is combined with a filter element 83. In FIG. 10D, three filter elements 101, 82, and 83 are combined. But only a small number of the possible combinations of filter elements are illustrated by the embodiments of FIGS. 10A–10D. Therefore, the embodiments of figured 10A–10D should not be viewed as limiting the possible combinations of filter elements. Rather, it should be apparent that any number of filter elements, of any type, can be combined as required by a particular implementation.

It should also be remembered, that the individual antenna elements disclosed herein can be combined to form multi-element, multi-band antennas, such as those disclosed in FIGS. 7A–7B, 8A–8D, and 9A–9C of Co-pending U.S. patent application Ser. No. 10/133,717. Thus, one or more filter elements can be added to the antenna elements of the various multi-element, multi-band antennas disclosed in FIGS. 7A–7B, 8A–8D, and 9A–9C as required by a particular application and as described above.

Figure 11A:
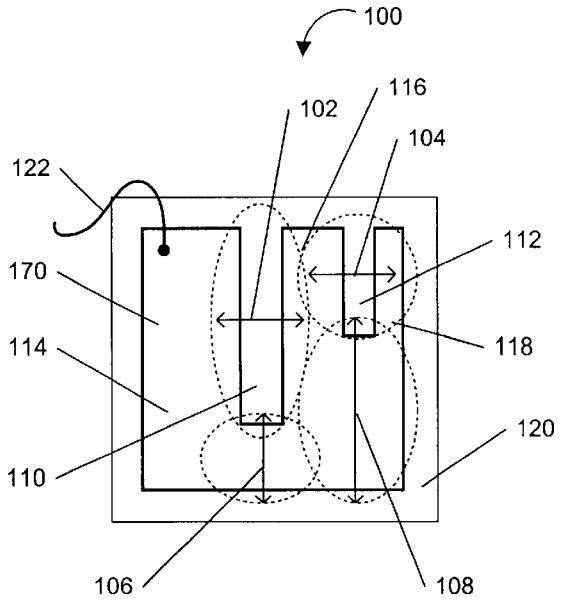
FIG. 11A is a diagram illustrating an exemplary single element, multi-band, capacitively loaded antenna.
Figure 11B:
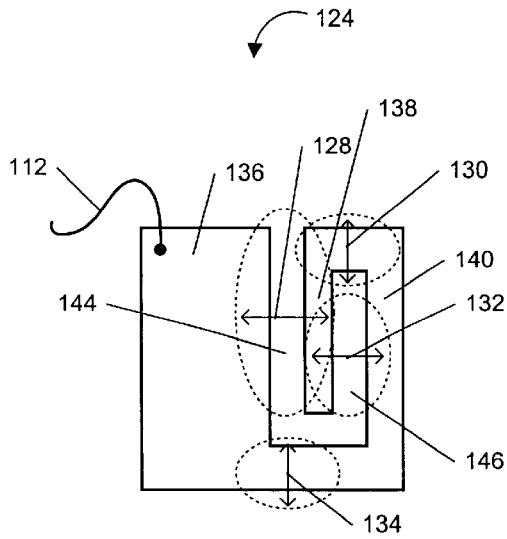
FIG. 11B is a diagram illustrating another exemplary single element, multi-band, capacitively loaded antenna.
Figure 11C:
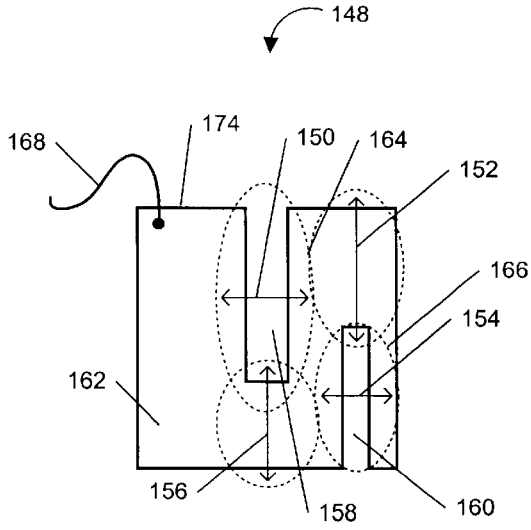
FIG. 11C is a diagram illustrating still another exemplary single element, multi-band, capacitively loaded antenna.

Further, several embodiment of a single element, multi-band antennas are disclosed in FIGS. 11B–11C and the accompanying description of Co-pending U.S. patent application Ser. No. 10/133,717. These figures and the accompanying descriptions are specifically incorporated herein by reference as if set forth in full. In these embodiments, a single top plate is configured to form multiple antenna elements, each with their own frequency range or band of operation. These single elements, multi-band antennas can also be combined with other antenna elements, such as those disclosed in Co-pending U.S. patent application Ser. No. 10/133,717. For example, FIGS. 14A and 14B of Co-pending U.S. patent application Ser. No. 10/133,717 and the accompanying description, incorporated herein by reference in the entirety, illustrate how antenna elements can be stacked with the antenna elements of FIGS. 11B–11C. It will be apparent, however, that filter elements, such as those described above, can also be added to such single element, multi-band antennas, whether alone or combined with other antenna elements, in accordance with the methods disclosed herein.

FIG. 11A is a diagram of one possible embodiment of such a single element, multi-band antenna 100. Antenna 100 comprises a top plate 170 that has been cut so that it comprises cutouts 110 and 112. The cutouts form three arms 114, 116, and 118, which form two antenna elements. Arms 114 and 116 form the capacitive part 102 of the first element, while arms 116 and 118 form the capacitive part 104 of the second element. The inductive parts of the two elements, 106 and 108 respectively, are formed between ground plate 120 and top plate 170 in the same manner as described in relation to antenna 10. Antenna 100 also comprises a ground contact (not shown) between top plate 170 and ground plate 120. Filter elements, such as those described above, can then be added as required, and in accordance with the methods described herein, to antenna 100.

FIG. 11B illustrates another exemplary single element, multi-band antenna 124. Cutouts 128 and 146 form three arms 136, 138, and 140, which form two antenna elements. Arms 136 and 138 form the capacitive part 128 of the first element, and arms 138 and 140 from the capacitive part 132 of the other. Antenna 124 also comprise a ground plate and ground contact that are not shown in FIG. 11B for simplicity. But the ground plate, in conjunction with the top plate 172, forms the inductive parts, 134 and 130, of the two antenna elements respectively. Again, filter elements, such as those described above, can be added as required, and in accordance with the methods described herein, to antenna 124.

FIG. 11C illustrates another exemplary single element, multi-band antenna 148. Cutouts 158 and 160 form three arms 162, 164, and 166, which form two antenna elements. Arms 162 and 164 form the capacitive part 150 of the first element, and arms 164 and 166 from the capacitive part 154 of the other. Antenna 148 also comprise a ground plate and ground contact that are not shown in figure 11C for simplicity. But the ground plate, in conjunction with the top plate 174, forms the inductive parts, 156 and 152, of the two antenna elements respectively. Again, filter elements, such as those described above, can be added as required, and in accordance with the methods described herein, to antenna 148.

While embodiments and implementations of the invention have been shown and described, it should be apparent that many more embodiments and implementations are within the scope of the invention. Accordingly, the invention is not to be restricted, except in light of the claims and their equivalents.

We claim:

1. An antenna element, comprising:

a top plate, the top plate comprising a first arm and a second arm adjacent to the first arm, the first and second arms configured to form a capacitive part of the antenna element;

a filter element comprising a cutout such that the first arm comprises a cutout plate and a base plate; and a ground plate electrically connected with the first and second arms, the ground plate configured to create an inductive part of the antenna element with the first and second arms.

2. The antenna element of claim 1, wherein the cutout comprises a geometry, the geometry configured such that the cutout, the cutout plate, and the base plate form a capacitive filter element with desired filtering characteristics.

3. The antenna element of claim 1, wherein the cutout plate is powered by electro-magnetic coupling from the base plate.

4. An antenna element, comprising:

a top plate, the top plate comprising a first arm and a second arm adjacent to the first arm, the first and second arms configured to form a capacitive part of the antenna element;

a filter element comprising a plurality of cutouts configured to form a second order filter element, the second order filter element comprising desired filtering characteristics; and a ground plate electrically connected with the first and second arms, the ground plate configured to create an inductive part of the antenna element with the first and second arms.

5. An antenna element, comprising:

a top plate, the top plate comprising a first arm and a second arm adjacent to the first arm, the first and second arms configured to form a capacitive part of the antenna element;

a filter element comprising a capacitive plate and a bottom plate electrically coupled with the first arm and the capacitive plate; and a ground plate electrically connected with the first and second arms, the ground plate configured to create an inductive part of the antenna element with the first and second arms.

6. The antenna element of claim 5, wherein the capacitive plate comprises a geometry, the geometry configured such that the capacitive plate forms a capacitive filter element with desired filtering characteristics.

7. The antenna element of claim 6, wherein the filter element comprises a second plate configured to form a LC filter element with the first plate, the LC filter element comprising desired filtering characteristics.

8. The antenna element of claim 5, wherein the bottom plate comprises a cutout or a plurality of cutouts, the cutout or the plurality of cutouts configured such that the cutout or the plurality of cutouts and the capacitive plate form a second order filter element with desired filtering characteristics.

9. An antenna element, comprising:

a top plate, the top plate comprising a first arm and a second arm adjacent to the first arm, the first and second arms configured to form a capacitive part of the antenna element;

a connection section connecting the first and second arms, the connection section comprising a filter element configured to reject a certain frequency; and a ground plate electrically connected with the first and second arms, the ground plate configured to create an inductive part of the antenna element with the first and second arms.

10. The antenna element of claim 9, wherein the connection section further comprises a plurality of filter elements, each of the plurality of filter elements configured to reject a certain frequency.

11. A multi-band antenna comprising a plurality of antenna elements, each of the plurality of antenna elements comprising:

a top plate, the top plate comprising a first arm and a second arm adjacent to the first arm, the first and second arms configured to form a capacitive part of the antenna element;

a filter element; and a ground plate electrically connected with the first and second arms, the ground plate configured to create an inductive part of the antenna element with the first and second arms;

wherein the filter element of at least one of the plurality of antenna elements comprises a cutout configured such that the first arm comprises a cutout plate and a base plate.

12. The antenna element of claim 11, wherein the cutout comprises a geometry, the geometry configured such that the cutout, the cutout plate, and the base plate form a capacitive filter element with desired filtering characteristics.

13. The antenna element of claim 11, wherein the cutout plate is powered by electro-magnetic coupling from the base plate.

14. A multi-band antenna comprising a plurality of antenna elements, each of the plurality of antenna elements comprising:

a top plate, the top plate comprising a first arm and a second arm adjacent to the first arm, the first and second arms configured to form a capacitive part of the antenna element;

a filter element; and a ground plate electrically connected with the first and second arms, the ground plate configured to create an inductive part of the antenna element with the first and second arms;

wherein the filter element of at least one of the plurality of antenna elements comprises a plurality of cutouts configured to form a second order filter element, the second order filter element comprising desired filtering characteristics.

15. A multi-band antenna comprising a plurality of antenna elements, each of the plurality of antenna elements comprising:

a top plate, the top plate comprising a first arm and a second arm adjacent to the first arm, the first and second arms configured to form a capacitive part of the antenna element;

a filter element; and a ground plate electrically connected with the first and second arms, the ground plate configured to create an inductive part of the antenna element with the first and second arms;

wherein the filter element of at least one of the plurality of antenna elements comprises a capacitive plate and a bottom plate electrically coupled with the first arm and the capacitive plate.

16. The antenna element of claim 15, wherein the capacitive plate comprises a geometry, the geometry configured such that the capacitive plate forms a filter element with desired filtering characteristics.

17. The antenna element of claim 16, wherein the filter element comprises a second plate configured to form a LC-filter element with the first capacitive plate, the LC-filter element comprising with desired capacitive characteristics.

18. The antenna element of claim 15, wherein the capacitive plate comprises a geometry, the geometry configured such that the capacitive plate forms a filter element with desired filtering characteristics.

19. A multi-band antenna comprising a plurality of antenna elements, each of the plurality of antenna elements comprising:

a top plate, the top plate comprising a first arm and a second arm adjacent to the first arm, the first and second arms configured to form a capacitive part of the antenna element;

a filter element; and a ground plate electrically connected with the first and second arms, the ground plate configured to create an inductive part of the antenna element with the first and second arms;

wherein at least one of the plurality of antenna elements further comprises a connection section connecting the first and second arms, the connection section comprising a filter element configured to reject a certain frequency.

20. The antenna element of claim 19, wherein the connection section further comprises a plurality of filter elements, each of the plurality of filter elements configured to reject a certain frequency.

21. A single element, multi-band antenna comprising:

a top plate, the top plate comprising a plurality of arms configured to form a plurality of antenna elements and to form a capacitive part of each of the plurality of antenna elements;

a filter element; and a ground plate electrically connected with the plurality of arms, the ground plate configured to create an inductive part of each of the plurality of antenna elements with the plurality of arms;

wherein the filter element comprises a cutout configured such that one of the plurality of arms comprises a cutout plate and a base plate.

22. The single element, multi-band antenna of claim 21, wherein the cutout comprises a geometry, the geometry configured such that the cutout, the cutout plate, and the base plate form a capacitive filter element with desired filtering characteristics.

23. The single element, multi-band antenna of claim 21, wherein the cutout plate is powered by electro-magnetic coupling from the base plate.

24. A single element, multi-band antenna comprising:

a top plate, the top plate comprising a plurality of arms configured to form a plurality of antenna elements and to form a capacitive part of each of the plurality of antenna elements;

a filter element; and a ground plate electrically connected with the plurality of arms, the ground plate configured to create an inductive part of each of the plurality of antenna elements with the plurality of arms;

wherein the filter element comprises a plurality of cutouts configured o form a second order filter element, the second order filter element comprising desired filtering characteristics.

25. A single element, multi-band antenna comprising:

a top plate, the top plate comprising a plurality of arms configured to form a plurality of antenna elements and to form a capacitive part of each of the plurality of antenna elements;

a filter element; and a ground plate electrically connected with the plurality of arms, the ground plate configured to create an inductive part of each of the plurality of antenna elements with the plurality of arms;

wherein the filter element comprises a capacitive plate and a bottom plate electrically coupled with one of the plurality of arms and the capacitive plate.

26. The single element, multi-band antenna of claim 25, wherein the capacitive plate comprises a geometry, the geometry configured such that the capacitive plate forms a capacitive filter element with desired filtering characteristics.

27. The single element, multi-band antenna of claim 26, wherein the filter element comprises a second plate configured to form a LC-filter element with the first plate, the LC-filter element comprising desired filtering characteristics.

28. The single element, multi-band antenna of claim 25, wherein the bottom plate comprises a cutout or a plurality of cutouts, the cutout or the plurality of cutouts and the capacitive plate form a second order filter element with desired filtering characteristics.

29. A single element, multi-band antenna comprising:

a top plate, the top plate comprising a plurality of arms configured to form a plurality of antenna elements and to form a capacitive part of each of the plurality of antenna elements;

a filter element; and a ground plate electrically connected with the plurality of arms, the ground plate configured to create an inductive part of each of the plurality of antenna elements with the plurality of arms;

further comprising connection sections connecting the plurality of arms, wherein at least one of the connection sections comprises a filter element configured to reject a certain frequency.

30. The antenna element of claim 29, wherein the connection section further comprises a plurality of filter elements, each of the plurality of filter elements configured to reject a certain frequency.

* * * * *